United States Patent [19]

Ebner et al.

[11] 4,020,495

[45] Apr. 26, 1977

[54] SELF TESTING PHOTOTYPESETTER FLASH INTENSITY CONTROL SYSTEM

[75] Inventors: Peter R. Ebner, South Nashua; Louis E. Griffith, Hampstead, both of N.H.

[73] Assignee: Itek Corporation, Lexington, Mass.

[22] Filed: Dec. 29, 1975

[21] Appl. No.: 644,387

[52] U.S. Cl. ..... 354/5; 355/68

[51] Int. Cl.[2] ..... B41B 13/00

[58] Field of Search ..... 354/4, 5, 7, 8, 10; 250/201, 205; 315/151; 355/68

[56] References Cited

UNITED STATES PATENTS

| | | | |
|---|---|---|---|
| 3,710,698 | 1/1973 | Sinnott et al. | 354/7 |
| 3,738,242 | 6/1973 | Lee et al. | 354/4 |

*Primary Examiner*—John Gonzales
*Attorney, Agent, or Firm*—Homer O. Blair; Robert L. Nathans; Gerald H. Glanzman

[57] ABSTRACT

An optical sensor is positioned at the output of a variable magnification optical system which focuses differing character size images upon a photosensitive medium. A reference voltage, which is a function of the proper exposure for a particular photosensitive medium, is compared with the photosensor voltage. The system automatically tests for the correct light flux before each size change by projecting a reference image through the optical system at the photosensor, such image having a relatively low intensity level, so that no output signal is produced by the above-mentioned comparator. The intensity of the reference image is iteratively increased until such output signal is produced by the comparator, thereby to maintain the light intensity at the last level attained, until a character size change is effected, wherein the comparison process is repeated. Upon the substitution of another photosensitive medium having a different sensitivity, the comparator threshold voltage is altered accordingly to produce the proper illumination intensities for various character sizes tailored to the sensitivity of the second photosensitive medium.

18 Claims, 3 Drawing Figures

SELF TESTING PHOTOTYPESETTER FLASH INTENSITY CONTROL SYSTEM

BACKGROUND OF THE INVENTION

This invention relates to the field of phototypesetters, and more particularly to flash tube intensity control systems employed therein.

In our previously filed patent application entitled "Digital Flash Intensity Control System for Phototypesetter," U.S. Ser. No. 628,692, filed Nov. 3, 1975, and assigned to the same assignee of the present invention, we described a system for storing letter size codes for controling the flash intensity for particular letter sizes to be set. Where a particular letter size is to be projected through the optical system, an appropriate code is read out of storage and addresses digitally controlled flash circuits, which convert the codes to an analog signal, which in turn controls the degree of energization and hence the light intensity of the flash tube.

While the above-mentioned system is generally satisfactory, it is deemed desirable to provide a self-testing closed loop system, which automatically produces the correct digital code for any particular character size just before phototypesetting. With this system, the machine is self-testing and only a reference voltage need be established to automatically produce the proper intensity codes for any character size. Thus, the permanent letter size codes for controling flash intensity for each letter size need not be predetermined and placed into permanent storage upon the manufacture of the phototypesetter and thus, manufacturing costs are reduced. Futhermore, when a second photosensitive medium replaces a first photosensitive medium in the machine, the speed or sensitivity of the second medium may differ from the sensitivity of the first medium, so that it is desirable to produce letter size codes for each particular character size having somewhat varying values to compensate for the change in sensitivity, thereby to maintain the desired image density constant. Also, since the system functions in a closed loop mode, any parameter changes in components for generating and projecting the character images will be automatically compensated for, in contrast with permanent storage of letter size codes for controling intensities.

SUMMARY OF THE INVENTION

In accordance with a preferred embodiment of the invention, a flash tube illuminates a reference object before a character size change, which in turn projects a reference optical image through the character imaging optical system, having lenses positioned to control the character size focused on the photosensitive medium. Such reference image is projected at a photosensor in the imaging plane which produces a voltage which is compared with a reference voltage by a voltage comparator. During the first projection step, the output of the voltage comparator indirectly causes a second code having a value higher than the initial code to control the second flashing of the lamp at a higher intensity level. This increases the light intensity of the second reference image impinging upon the photosensor and the process iteratively repeats itself until the photosensor voltage is finally greater than the reference voltage, which in turn halts the stepping process and causes the last generated code to continuously control the flashing of the flash tube at the last attained intensity level during typesetting until a character size change condition causes the system to repeat the above intensity level seeking steps. If a more sensitive film is thereafter employed, the reference voltage level is decreased by the operator, so that an output signal is produced by the voltage comparator earlier in the process to utilize a code having a lower value to thereafter control the flash intensity of the character disc flash tube to in turn decrease the flash intensity to maintain the density of images focused upon the more sensitive film constant. Where less sensitive film is employed, the reference voltage level on the other hand is increased to produce the opposite effect.

Other objects, features, and advantages of the present invention will become apparent upon the perusal of the following description taken in conjunction with the figures in which:

FIG. 1 schematically illustrates one embodiment of the invention;

FIG. 2 illustrates developed images of the reference window focused upon a newly inserted photosensitive medium which may have a varying sensitivity relative to the prior medium; and FIG. 3 illustrates the relationship between the sequentially produced photosensor voltages relative to the comparator threshold level.

DETAILED DESCRIPTION

Figure 1:
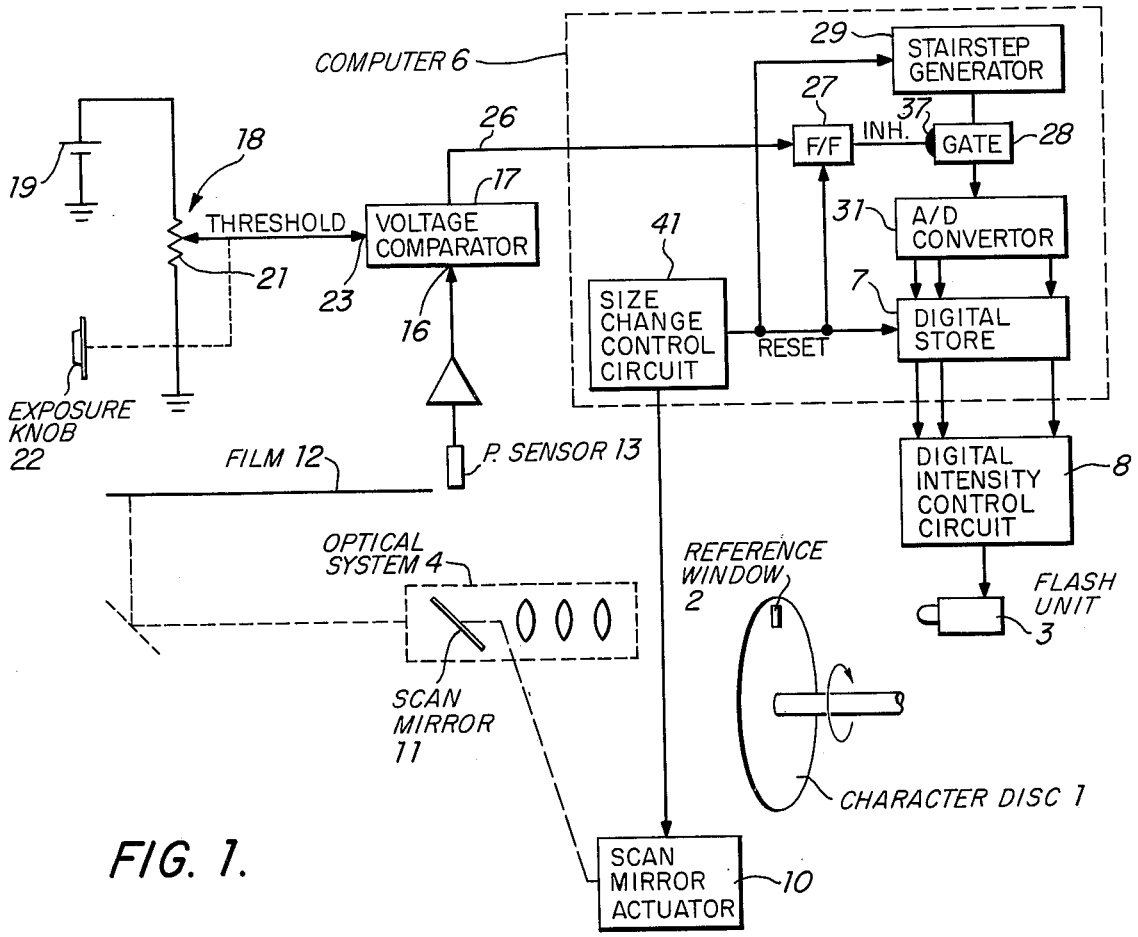

Referring now to FIG. 1, a character storage disc 1 having a reference object window 2 is positioned between light illumination source or flash unit 3 and the input to optical projection system 4. As is widely understood by those familiar with so-called second generation phototypesetters, a character disc 1 bears timing marks for actuating counters which produce codes to in turn effect the selective flashing of desired characters, all in accordance with techniques well understood.

A programming or computer unit 6 is schematically illustrated and performs numerous control functions, not described, which form no part of the present invention. While, in the phototypesetter designed by the inventors, most of the control functions are controlled by a computer program, it is believed that greater clarity will be attained if the invention is described in terms of hardware which, of course, could be utilized to perform the functions of the invention if desired. Digital store 7 is coupled to digital intensity control circuit 8, which controls the intensity of light produced by flash unit 3. For details of the foregoing, the readers attention is directed to the above-mentioned co-pending patent application wherein a digital to analog converter controls the amplitude of pulses produced by a square wave oscillator, which in turn controls the energy associated with the electrical charge employed to energize the flash lamp. Changes in the value of digital letter size codes contained within store 7 will change the amplitude of the square wave pulses to alter the rectified DC signal applied across an intergrating capacitor which stores the above-mentioned energizing charge.

Upon the initiation of a "change in character size " command state, a scan mirror 11 is driven by a stepping motor represented by mirror actuator 10 to the position illustrated, along the edge of the photosensitive medium or film 12. The lenses of optical system 4 are also selectively stepped to assume relative positions as a function of the desired projected character image size, all in accordance with well known lens formulas. Since such mechanisms form no part of the present invention, they will not be further described herein.

Figure 3:
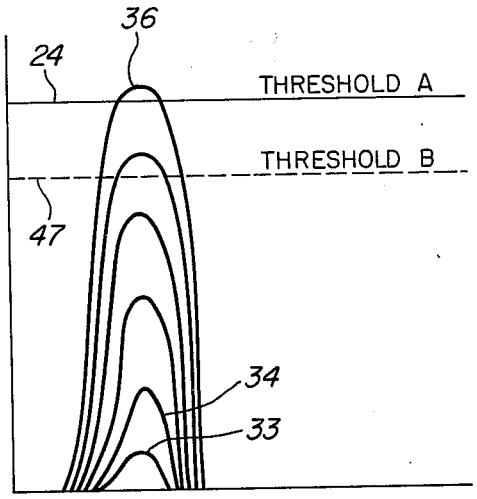

Upon the above-mentioned positioning of scan mirror 11 by scan mirror actuator 10, the character size change command causes flash unit 3 to illuminate reference object or window 2, which produces a reference image to be focused upon photosensor 13 by optical system 4. The light intensity measuring device or photosensor is positioned to intercept a central portion of the projected reference image, so that it in turn generates a voltage proportional to the intensity of the image, such voltage being applied to a first input terminal 16 of voltage comparator 17. A potentiometer 18 is coupled across voltage source 19 and has a movable brush 21 having a position controlled by a mechanical actuator or exposure knob 22. The voltage at the brush is applied to second input terminal 23 of voltage comparator 17 to establish a reference or threshold voltage for the comparator, illustrated conceptually by the horizontal line 24 in FIG. 3.

The following stair step wave operation is merely one approach of many which may be employed, but is believed to be appropriate in clearly explaining the principle of the invention. The first generated flash of low intensity causes a relatively low amplitude pulse to be applied to the first input terminal 16 of voltage comparator 17, so that no output signal is produced at the comparator output terminal 26; flip flop 27 is not actuated and thus, AND gate 28 is in the opened state to permit the output of stair step generator 29 to be applied to analog to digital converter 31. The voltage pulse applied to the first terminal of comparator 16 is indicated by pulse 33 in FIG. 3. The second flashing step is initiated by applying the elevated "second step" of the voltage wave generated by stair step generator 29 to the analog to digital converter 31 via gate 28, which in turn introduces a second test code of higher value into digital store 7 to cause flash unit 3 to flash reference window 2 at a greater intensity to in turn produce a higher voltage pulse at the input terminal 16 of comparator 17, such pulse being designated as 34 in FIG. 3. Since the amplitude of pulse 34 is still lower than threshold level 24, flip flop 27, coupled to the comparator output circuit, is still not actuated, and the process continues until a voltage is produced at the input terminal to voltage comparator 17 which has an amplitude greater than threshold level 24. This pulse is designated as 36 in FIG. 3.

The iterative process is now terminated, since an output signal has just been produced by comparator 17 to actuate flip flop 27, which applies an inhibit signal at inhibit terminal 37 of gate 28, so that the last stored code within digital store 7 is for the first time not increased in value, and this code continues to control flash unit 3 to maintain the proper exposure level until a new character size change signal is generated by control circuit 41, which signal again causes scan mirror actuator 10 to position scan mirror 11 adjacent photosensor 13. The scan mirror, of course, normally steps in the X direction across film 12 during phototypesetting. Control circuit 41 further resets flip flop 27 and clears digital store 7 in preparation for the next testing cycle to begin. Since flip flop 27 is reset, the "first step" signal produced by reactivated stair step generator 29 is again applied to converter 31 via the now enabled gate 28 to repeat the foregoing process.

It should now be understood that the iterative process described hereinabove occurs upon a "change in character size" command and automatically applies a final code to intensity control circuit 8, which has a proper value for the called for character size due to the above-mentioned process. If the lenses in optical system 4 produce a highly magnified character image for a large character size, the signals produced by photosensor 13 for each of the above-mentioned steps will be of lesser amplitudes. Since the system operates in a closed loop mode, this will be of no moment, since the comparator 26 will not produce an output signal until a greater number of flashing steps cause a larger code representing a higher illumination intensity to be stored in digital store 7. On the other hand, if a relatively small character size is called for to cause a small image of reference window 2 to be projected at photosensor 13, the light intensity will be greater, at the photosensor so that fewer flashing steps are required to cause the voltage pulses applied at 16 to reach the threshold, which in turn will cause a code of lower value to be stored in digital store 7 to decrease the illumination intensity of the light produced by flash unit 3. In summary, flash unit 3 will produce a relatively low intensity light flash level for smaller characters to be projected and a relatively high intensity flash level for larger characters, which automatically maintains the image density of developed character images upon film 12 constant.

Figure 2:
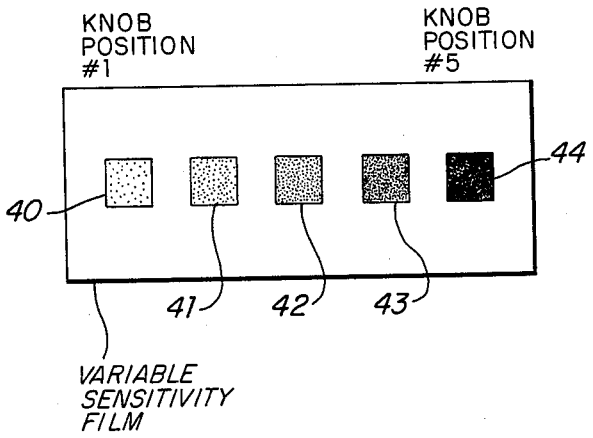

Now let it be assumed that a second photosensitive medium replaces the prior film supply, which second medium is more sensitive than the prior film supply. Reference window 2 is sequentially flashed while scan mirror 11 steps across film 12. Since flash unit 3 is sequentially energized to produce increasingly greater illumination intensities, a series of images 40, 41, 42, 43, and 44 of increasing density are produced upon the development of the film as indicated in FIG. 2. The operator now examines the images and determines the image which possesses the most desired density. He thereafter changes the position of exposure knob 22 to alter the threshold voltage applied to comparator 17 so that the knob position correlates with the position of the best image. For example, if the fresh film is more sensitive than the previously used film, exposure knob will be rotated so that brush 21 will be positioned closer to ground to decrease such potential. This new threshold "B" is represented by line 47 in FIG. 3. As a result of lowering of the threshold voltage, less steps will be required to produce the above-mentioned voltage comparator output signal then before, and thus, the values of the codes retained in digital store 7 will be somewhat lower for the various character sizes. In other words, the entire set of codes representative of all character sizes would be decreased in value in accordance with the greater sensitivity of the replacement film. On the other hand, if the replacement film is less sensitive than the previously used film, a greater threshold level is established, and a greater number of steps are required to complete the iterative process, and thus, the entire set of codes representing all character sizes will be higher then before to cause the final intensity levels of the flash signals to be higher as a group, so as to maintain image density constant.

An interesting aspect of the invention is that the proper threshold level for a film of given sensitivity is automatically stored in the machine, even though the machine is turned off, since the threshold is established by the position of exposure knob 22 and the above-mentioned permanent storage of character size codes is eliminated. Thus, the system of the present invention is highly flexible and provides alterations of the values of all letter size codes depending upon the sensitivity of the film, besides eliminating the permanent storage of letter size codes as in the above-mentioned prior system. Furthermore, the system of the present invention may function to compensate for any effects of changes in the parameters of the character image generating components with aging, etc.

Obviously, numerous techniques may be employed to carry out the functions set forth above. For example, a gated clock pulse train generator for sequentially increasing the code in a binary counter with each step of the threshold seeking method may be employed in lieu of a stair step wave generator arrangement described above. While the voltages applied to comparator 17 in the typesetter built by the inventors sequentially increase, it is believed feasible to decrease the voltages applied to comparator 17 by starting with a very intense flash, until the reference voltage is reached. Also, other predetermined relationships such as predetermined ratios between the signals applied to the comparator rather than equality conditions, may be detected. It is possible that an optical comparator may be employed for comparing a light reference signal with the light projected by scan mirror 11 rather than an electrical comparator. The reference image could take the form of a predetermined character such as the letter *i* rather than the rectangular image produced by the more preferred window 2.

The term light source is also intented to include the case of two flash tubes, or other light sources, one for characters and one for a separate reference image generator should such be employed.

While preferred embodiments of the invention have been described, the teachings of the invention will readily suggest many other embodiments to those skilled in the art.

What is claimed is:

1. A system for establishing proper character illumination intensities in a phototypesetter for various character sizes comprising:

a. a character projection optical system for imaging a character upon a photosensitive medium;

b. a character image generator including a light source for producing character light images at the input of said character projection optical system;

c. a light intensity measuring means for measuring the intensity of light emerging from said character projection optical system;

d. a reference signal generating means;

e. a comparator for comparing the signal produced by said reference signal generating means and the signal produced by said light intensity measuring means and for producing an output signal when the signal produced by said light intensity measuring means assumes a given relationship with respect to the value of the signal produced by said reference signal generating means;

f. a reference image generating means including said light source for projecting a reference image through said character projection optical system and at said light intensity measuring means;

g. first light source intensity control means for causing said light source to sequentially illuminate said reference image generator at varying intensity levels until the value of the signal produced by said light intensity measuring means assumes said predetermined relationship with respect to the value of the signal produced by said reference signal generating means, thereby to cause said comparator to generate said output signal; and h. second control means responsive to the generation of said output signal by said comparator for causing said first light source intensity control means to cease changing the intensity of light produced by said light source, thereby to establish the intensity of character images projected upon said photosensitive medium during typesetting.

2. The system as set forth in claim 1 wherein said reference signal generating means includes mechanical actuating means for changing the value of the signal produced by said reference signal generating means as a function of its position thereof.

3. The system as set forth in claim 2 wherein said reference signal generating means includes a variable impedance device having an impedance which varies as a function of the position of said actuating means.

4. The system of claim 1 wherein said light intensity measuring means is positioned to measure a central portion of the reference image projected through said optical system and at said light intensity measuring means.

5. The system of claim 2 wherein said light intensity measuring means is positioned to measure a central portion of the reference image projected through said optical system and at said light intensity measuring means.

6. The system of claim 3 wherein said light intensity measuring means is positioned to measure a central portion of the reference image projected through said optical system and at said light intensity measuring means.

7. A system for establishing proper character illumination intensities in a phototypesetter for various character sizes comprising:

a. a character projection optical system for imaging a character upon a photosensitive medium;

b. a character image storage device;

c. a light source for illuminating selected characters associated with said storage device to produce a character image at the input of said character projection optical system;

d. a light intensity measuring means for measuring the intensity of light emerging from said character projection optical system;

e. a reference signal generating means;

f. a comparator for comparing the signal produced by said reference signal generating means and the signal produced by said light intensity measuring means and for producing an output signal when the signal produced by said light intensity measuring means assumes a given relationship with respect to the value of the signal produced by said reference signal generating means;

g. a reference image generating means for projecting a reference image through said character projection optical system and at said light intensity measuring means;

h. first light source intensity control means for causing said light source to sequentially illuminate said reference image generator at varying intensity levels until the signal produced by said light intensity measuring means in turn is in the neighborhood of the signal produced by said reference signal generating means, thereby to cause said comparator to generate said output signal; and i. a second control means coupled to said comparator, responsive to the generation of said output signal by said comparator for causing said first light source intensity control means to cease changing the intensity of light produced by said light source, thereby to establish the intensity of character images projected upon said photosensitive medium during typesetting of characters which are to have the same size.

8. The system as set forth in claim 7 wherein said reference signal generating means includes mechanical actuating means for changing the value of the signal produced by said reference signal generating means as a function of its position thereof.

9. The system as set forth in claim 8 wherein said reference signal generating means includes a variable impedance device having an impedance which varies as a function of the position of said actuating means.

10. The system of claim 7 wherein said light intensity measuring means is positioned to measure a central portion of the reference image projected through said optical system and at said light intensity measuring means.

11. The system of claim 8 wherein said light intensity measuring means is positioned to measure a central portion of the reference image projected through said optical system and at said light intensity measuring means.

12. The system of claim 9 wherein said light intensity measuring means is positioned to measure a central portion of the reference image projected through said optical system and at said light intensity measuring means.

13. A method for establishing proper character illumination intensities in a phototypesetter for various character size images projected through a variable magnification optical system therein comprising:

a. projecting a first reference light image produced by a light illumination source at a light intensity measuring device through a variable magnification optical system;

b. measuring the intensity of the light of said reference light image so projected and comparing the measured intensity thereof to a reference signal;

c. projecting a second reference light image produced by said illumination source at said light intensity measuring means through said optical system having an intensity which differs from the intensity of the first reference image previously projected at said light intensity measuring means and again comparing the measured intensity of said reference image signal with said reference signal;

d. repeating steps *a*, *b*, and *c* until the measured intensity of the reference image assumes a given relationship with respect to said reference signal and thereafter e. maintaining the intensity of light produced by said illumination source constant during further phototypesetting of characters of the same size projected through said optical system.

14. The method of claim 13 further including repeating the steps of paragraphs *a-d* before projecting character images of a different size through said optical system.

15. The method of claim 14 wherein the light intensity of the reference image is increased step by step until the value of the intensity of light measured by said light intensity measuring means exceeds the value of said reference signal.

16. The method of claim 13 including the additional step of:

a. removing a first supply of photosensitive material from said phototypesetter and replacing such material with a second supply of photosensitive material having a sensitivity which may differ from the sensitivity of the first supply of photosensitive material;

b. sequentially projecting reference images of varying intensities upon said second photosensitive material;

c. examining the images produced by the preceding step and selecting a particular image having the desired density; and d. altering said reference signal in a manner to correlate the value thereof to the selected image.

17. The method of claim 14 including the additional step of:

a. removing a first supply of photosensitive material from said phototypesetter and replacing such material with a second supply of photosensitive material having a sensitivity which may differ from the sensitivity of the first supply of photosensitive material;

b. sequentially projecting reference images of varying intensities upon said second photosensitive material;

c. examining the images produced by the preceding step and selecting a particular image having the desired density; and d. altering said reference signal in a manner to correlate the value thereof to the selected image.

18. The method of claim 15 including the additional step of:

a. removing a first supply of photosensitive material from said phototypesetter and replacing such material with a second supply of photosensitive material having a sensitivity which may differ from the sensitivity of the first supply of photosensitive material;

b. sequentially projecting reference images of varying intensities upon said second photosensitive material;

c. examining the images produced by the preceding step and selecting a particular image having the desired density; and d. altering said reference signal in a manner to correlate the value thereof to the selected image.

* * * * *